US007488920B2

(12) United States Patent
de los Toyos et al.

(10) Patent No.: US 7,488,920 B2
(45) **Date of Patent: *Feb. 10, 2009**

(54) RADIANT HEATER IN A COOKING HOB WITH A THERMAL SWITCH

(75) Inventors: Daniel de los Toyos, Eibar (ES); Jon Endika Azpiritxaga, Durango (ES)

(73) Assignee: Eika, S. Coop, Etxebarria (ES)

( * ) Notice: Subject to any disclaimer, the term of this patent is extended or adjusted under 35 U.S.C. 154(b) by 208 days.

This patent is subject to a terminal disclaimer.

(21) Appl. No.: 11/473,203

(22) Filed: Jun. 22, 2006

(65) Prior Publication Data

US 2006/0241890 A1 Oct. 26, 2006

Related U.S. Application Data

(63) Continuation-in-part of application No. 10/965,924, filed on Oct. 14, 2004, now Pat. No. 7,087,866.

(30) Foreign Application Priority Data

Jun. 14, 2004 (ES) ..... 200401433 U

(51) Int. Cl.
*H05B 3/68* (2006.01)

(52) U.S. Cl. ..... 219/448.11; 219/460.1

(58) Field of Classification Search ... 219/443.1–468.2; 337/333–365

See application file for complete search history.

(56) References Cited

U.S. PATENT DOCUMENTS

| | | | | |
|---|---|---|---|---|
| 4,059,817 | A | 11/1977 | Hollweck et al. | |
| 4,791,397 | A | 12/1988 | Wells | |
| 5,270,519 | A * | 12/1993 | Higgins | 219/448.19 |
| 6,121,587 | A | 9/2000 | Leiprecht et al. | |
| 6,150,641 | A * | 11/2000 | Wilkins | 219/512 |
| 6,756,569 | B2 | 6/2004 | Bates et al. | |
| 7,087,866 | B2 * | 8/2006 | de Los Toyos et al. | 219/448.11 |

FOREIGN PATENT DOCUMENTS

| | | |
|---|---|---|
| DE | 2627373 | 12/1977 |
| DE | 2901801 | 7/1980 |
| EP | 0249721 | 12/1987 |
| GB | 2316283 | 2/1998 |

* cited by examiner

*Primary Examiner*—Sang Y Paik
(74) *Attorney, Agent, or Firm*—Peter B. Scull; Berenbaum Weinshienk & Eason; Tim L. Kitchen

(57) ABSTRACT

The electric radiant heater (101) adapted to a cooking hob is attached to the cooking plate (2*a*) forming with it an air cavity (13) in which the extended heating resistor (105) is housed on an insulating base (104). A peripheral outer wall (3,6) of the heater defines said cavity (13) in which there is a thermal switch (107) positioned, having a bimetal sensor (107*c*) the compact body (107*a*) of which rests on a central area (104*a*) of the insulating base, and its metal heat-receiving base (107*b*) in a position facing a heating resistor segment (105*a*) and either very close to or above it making contact. The relative position of the bimetal sensor (107*c*) enables a switching point (SWC',SWO') of the electrical contact (109) to be set in correlation to the hotplate warning light temperature range (TU).

20 Claims, 4 Drawing Sheets

RADIANT HEATER IN A COOKING HOB WITH A THERMAL SWITCH

The present application is a "continuation in part" of the parent application U.S. Ser. No. 10/965,924, filed at Oct. 14, 2004, now U.S. Pat. No. 7,087,866, and now published as US 2005/0274710-A1.

TECHNICAL FIELD

The invention is related to a radiant heater for an electric cooking hob, provided with a thermal switch for turning on and off a warning lamp to indicate a state of the hot plate during heating and cooling.

PRIOR ART

Radiant heaters of the above-mentioned type are known, with a built-in thermal switch whose electrical contact is used for switching on a warning lamp indicating that the cooking plate is still "hot" with a hazardous residual temperature, the threshold of which is set at 60-70° C. The thermal switch has to switch the warning contact during the onset of the heating of the cooking plate as well as during cooling to warn of a residual temperature higher than the aforesaid threshold value. The bimetallic sensor does not make direct contact with the hot plate, but the switch response time should be correlated to the actual temperature of the heated plate zone. For this purpose the thermal switch is situated on an peripheral insulating zone of the heater receiving proportionally the heat transmitted to the plate, so that the temperature value reached in the sensing element, always higher than on the plate, closely follows the changes in said real value in the plate. The switch actuating point is set at a suitable temperature point for switching in both plate heating and cooling process or directions, taking into account also the thermal hysteresis of the switch, which leads to a lower switching point during cooling.

In the prior art radiant heaters, detecting the residual cooking plate temperature is effected by means of a bimetallic sensor separated from the plate itself, presents the problem of the influence of the heat transmitted from external adjacent heaters, which raises the ambient temperature and heats the peripheral wall of the heater equipped with the bimetal switch. This problem is particularly evident in the case of the so-called "warmer" type radiant heater, which is used solely for warming precooked foods or holding them at the maximum plate temperature of around 300° C. The power of the heater is low compared with the adjacent cooking heaters of the same hob, which heat their respective hob area up to 550° C. For this reason the cover or metal support tray that encircles the heater, ends up hot due to the transmission of the adjoining heaters switched on at the same time. The problem of the temperature in the outer wall of the heater becomes critical when the ceramic body of the bimetallic sensor is submitted directly to heating from the adjoining heaters, so that the sensitive disc of the bimetallic switch may reach a temperature of around 100° C., and it loses correlation with the actual temperature of the plate area it has to detect. Alternatively, the outer heating of the built-in bimetallic switch may come from heat sources below the heater.

In the known solutions, for example that disclosed in DE-A-2627373, the thermal switch for turning on the warning lamp is fixed at the peripheral edge of the heater and for its operation it has an expanding rod coupled to the heating resistors from which it receives heat.

In U.S. Pat. No. 6,121,587 a second bimetallic switch built into the radiant heater operates at a temperature of less than 100° C. to indicate residual heat and is disposed in an air duct built into the insulating outer wall of the heater, so that no expanding rod is needed for its actuation. But attached to the sensitive element this sensor has an additional heat transmitting member that receives the radiation of the heating resistors in order to obtain a quick response of the heat sensitive element of the cooking plate. Owing to the influence of external heating on the sensor, the bimetal disc does not follow the variation in the plate area heated closely, and it therefore requires a high adjusting point for actuating the switching contact, well separated from the maximum warning threshold value of 80° C. at the hot plate.

Publication U.S. Pat. No. 6,756,569-B2 describes a radiant heater or "warmer" only for warming, which uses a bimetallic switch for turning on a "hot" plate warning lamp. The sensor is built into the heater secured between the peripheral insulating ring and the horizontal base of the heater, in a hole space shaped to the outline of the body of the sensor. Owing to the fact that the ceramic body has no heat insulation against the transmission of external heat, the bimetallic disc may reach a temperature of more than 100° C., even when the heater if off. Therefore, while the heater plate area is cooling, the temperature detected at the bimetallic sensor follows an almost asymptotic slope above 100° C. (represented by the dotted line in FIG. 4) and the response time of the sensor in opening the electrical contact is very long and out of touch. When the adjacent heaters are off, the sensor bimetallic disc reaches a temperature 40° C. lower than in the other case. It is thus hard to find a setting point for the switching of the electrical contact in both directions. Further, one certain point of actuation of the sensor being set, after adding the differential interval due to the actual switching hysteresis of the switch, the temperature difference in the plate area, the difference between the moment of closure and the moment of opening, may reach as much as 70° C., even larger than an acceptable signalling interval of 50-80° C.

The type of thermal switch or bimetallic sensor used in the heaters in the prior art are of the type described in U.S. Pat. No. 4,059,817, provided with a cylindrical sensor body and a heat receiving metallic base in direct contact with the internal bimetallic temperature-sensitive disc. Another type of known bimetallic thermal switch incorporated in a radiant heater is described in publication DE-1123059-A, and it is also compact with a ceramic body whose heat-receiving side presents a recess through which a bimetallic plate is deformed, while the terminals are situated on the opposite side of the body, facing longitudinally.

DISCLOSURE OF THE INVENTION

The object of the present invention is an electric radiant heater adapted to a cooking hob with a top plate of the type glass-ceramic, provided with at least a radiant heater of lower power for carried out the process "warming" or "maintenance" of food, which is equipped a thermal switch including a bimetal thermal switch sensitive to a temperature of the radiant heater, for switching on and off a hot plate warning indicator above and below a residual temperature threshold value in the heated plate area, wherein the bimetal sensor is positioned close to a heating resistor segment, so that a quick and precise sensing response is obtained for said residual temperature.

The thermal sensing switch is fixed inside the heater separate from the cooking plate, isolated there from the influence of the adjacent heaters of the cooking hob. The temperature value detected is faithfully correlated to the true value in the heated plate area, both during heating and during cooling. Thereof the actuation of the switch is thereby achieved in both directions within an acceptable residual temperature range in the plate area of 65°±15.

The preferably bimetal type thermal switch is disposed in an air cavity within the heater under the cooking plate, wherein the heating resistors are mounted. The thermal switch used as a bimetal sensor, has a compact body whose heat receiving side for the sensing element is directly facing the radiation of the heating resistor, said receiving side resting according two embodiments close to a portion of the heating resistor or otherwise over a resistor segment engaging therewith, depending on how is conformed the insulating surface for the heating resistor portion support and guide. Positioned in this way, the bimetal sensor is isolated from the influence of the external heating produced by the adjacent cooking heaters switched on at the same time. A quick sensor response to plate heating is also achieved as well as precise temperature detection during cooling, closely correlated to the real value in the heated plate area. The response time to cooling is not delayed unnecessarily, due to the fact that the bimetallic sensor is isolated from the metal cover of the warmer heater, through the interposition between them of the peripheral isolating wall thereof, and its air cavity in which the sensor is enclosed inside the heater.

The radiant heater according to the invention does not use additional fixing means either for the bimetallic sensor, since it is situated up against a central surface of the heating resistor insulating carrier or base. The sensor is secured and pressed here by the elastic force of rigid electrical connection cables. In this way, its position relative to the heating resistors is fixed and does not vary either moved by the thermal constraints in the sensor body.

DETAILED DESCRIPTION OF THE INVENTION

Figure 1:
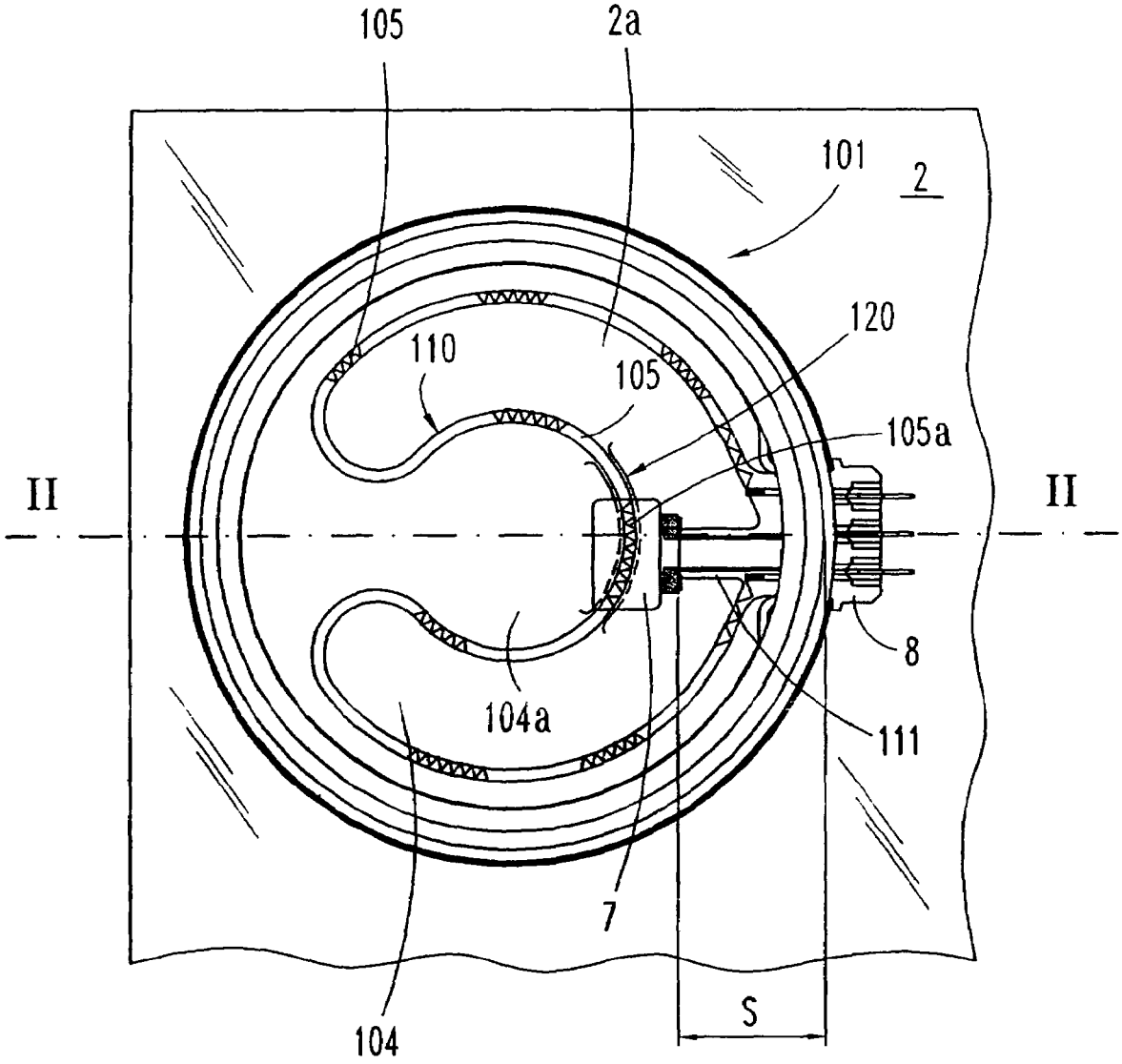
FIG. 1 is a plan view of a radiant electric heater adapted to a cooking plate, with a built-in thermal switch positioned as a bimetal sensor for a temperature indicator, according to first embodiment.

In reference to FIGS. 1-4, a preferred embodiment of radiant heater 101 is attached to cooking plate 2 of a cooker hob with various radiant heaters (not represented in the drawings), which are arranged below the cooking plate and close to one another, and the radiant heater 101 is formed of a cover or metal tray 3, an insulating base 4 holding at least one heating resistor, a peripheral insulating ring 6 in contact with the cooking plate, a compact thermal switch or bimetallic sensor 107, disposed in an air cavity 13 formed below the heated plate area 2*a*, between the insulating base 104 and the insulating ring 6, and an electrical connector 8, which transmits the power directly to the resistors.

The bimetallic sensor 107 has a compact, electrically insulating body 107*a* made of ceramic material resistant to the high temperature that is transmitted from the heating resistor 105. It is constructed with an external metal base 107*b*, 107*d* receiving heat on one side of the compact body 107*a*, and a bimetal disc 107*c* sensitive to the temperature connected thermally to said metal base 107*b*, 107*d*. A normally-open electrical contact 109 of the sensor is actuated at the regulated switching point SWC' (FIG. 4), which, upon closing, provokes the ignition of a signalling lamp or other "plate hot" warning device (not represented in the drawings) advising of the residual temperature of the heated plate area 2*a*.

The power of the heater described here as a specimen embodiment is 250 W, normally lower than the power of the adjacent 750-1250-watt hotplates. The heating resistor 105 may be made in planar or wire coil form and it is installed on a central surface area 104*a* of the insulating base guided in a groove 110. A commercial bimetal sensor 107 is chosen on grounds of economic cost and its compact body 107*a* is preferably square section and low height so as not to interfere in the installation of the glass ceramic plate on the radiant hotplate.

The height "H" of the air cavity 13 is 20-25 mm, similar to that of other heaters. Between the plate area 2*a* and the bimetal sensor 107 there is a separating space "B", for instance of 3 mm or less, i.e. a fitting clearance "B" the same as that of other cooking hotplates in order to use the same insulating ring 6 and metal tray 3 pieces. A minimal separating space "B" from the plate area 2*a* is preferable in order to improve the correlation between the "ZT" temperatures in the area of plate 2 and the "ST" in the bimetal sensor 107. The compact body 107*a* of the sensor 107 is insulated from the external thermal influence of the adjacent heaters, separated from the insulating ring 6 by an intervening space "S", the size of which depends on the distribution of the segments of heating resistor 105 and its coil-like configuration. The bimetal sensor 107 is disposed in the air cavity 13 of the radiant heater 101, resting on the central surface area 104*a* of the insulating base above a segment of resistor lO5*a* in order to improve heat transmission from the heating resistor 105 to the bimetal sensor 107.

Said heating resistor segment 105*a* is guided in a segment of insulating guiding groove 120, 120'. The heat-receiving metal base 107*b*, 107*d* is supported on the segment of guiding groove 120, substantially in contact with the resistor segment 105*a*, or separated from the latter by a very small accidental space, depending on the dimensional deviations of the insulating base 104*a* and the compact body of the sensor 107*a*. Owing to the formation of a protective layer of surface metallic oxide on the resistor 105, the metal base 107*b*, 107*d* is insulated electrically from the resistor segment 105*a*.

Figure 2:
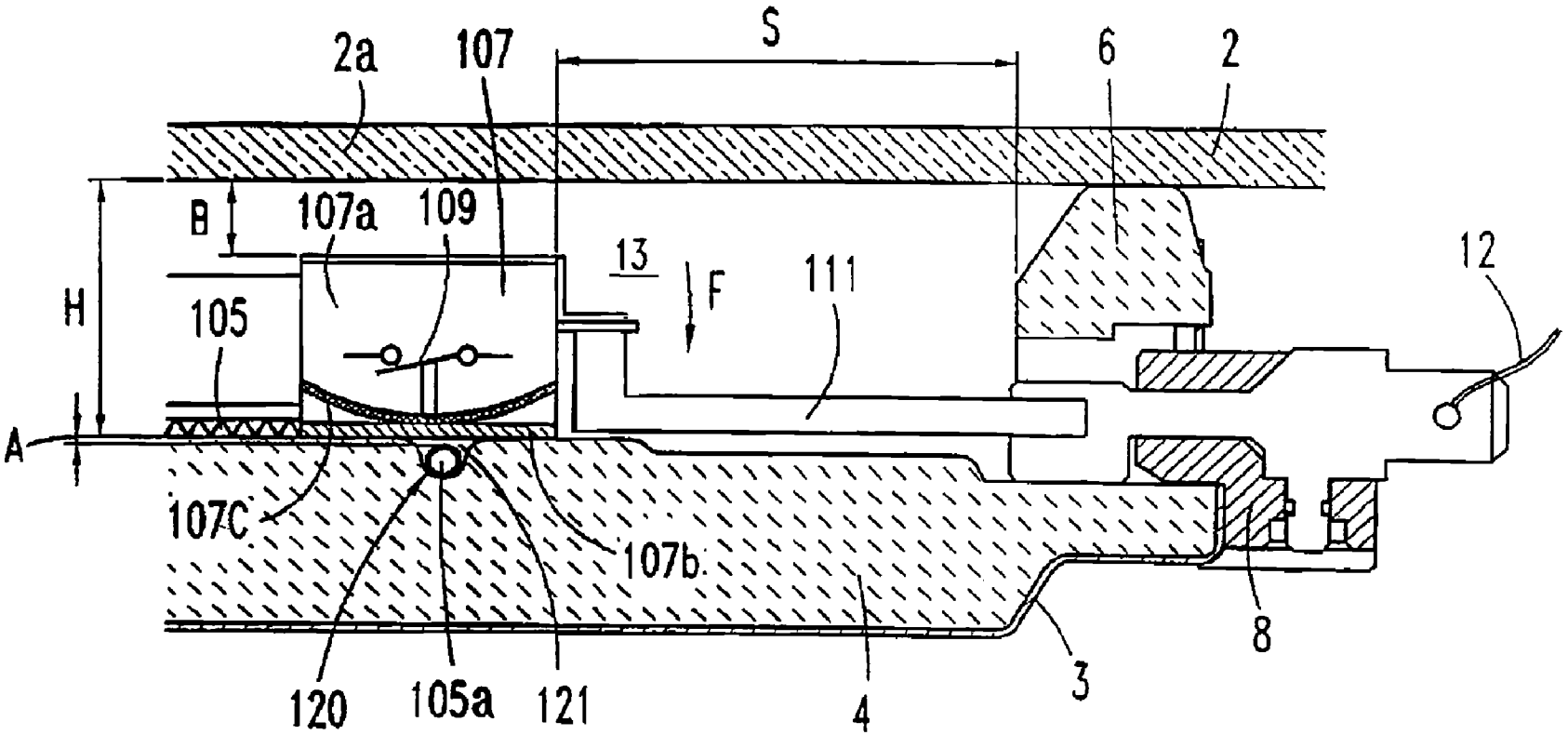
FIG. 2 is a partial sectional view of the radiant heater under the cooking plate according to line II-II in FIG. 1.

In reference to FIG. 2, an embodiment of heater 101 is shown in which said resistor segment 105*a* is housed in an insulating groove 120, of a width "W" and a depth "P". The metal base 107*b* of the bimetal sensor is completely flat and straight and the resistor segment 105*a* is fully sunken in the housing groove 120. The depth "P" and the width "W" of the groove are greater than the diameter "ϕ" of the resistor 105*a*. Between the metal base 107*b* and the housing groove 120 an air channel 121 is formed which constitutes a source of heat for the bimetal disc 107*c*. In the event of said spatial clearance "A" being such that there is no actual contact between the resistor segment 105*a* and the metal base 107*b*, 107*d* of the sensor, the air channel 121 transmits with the same efficacy the heat from the resistor segment as if said thermal contact actually existed between them. In this way, consistency of results is achieved on all the units of radiant heater 101 manufactured with the built-in bimetal sensor 107 in the detection of an "ST" temperature in the sensor (FIG. 1) correlated to the range 65"C±15 of temperature "ZT" in the heated area 2*a* of the cooking plate.

Figure 3:
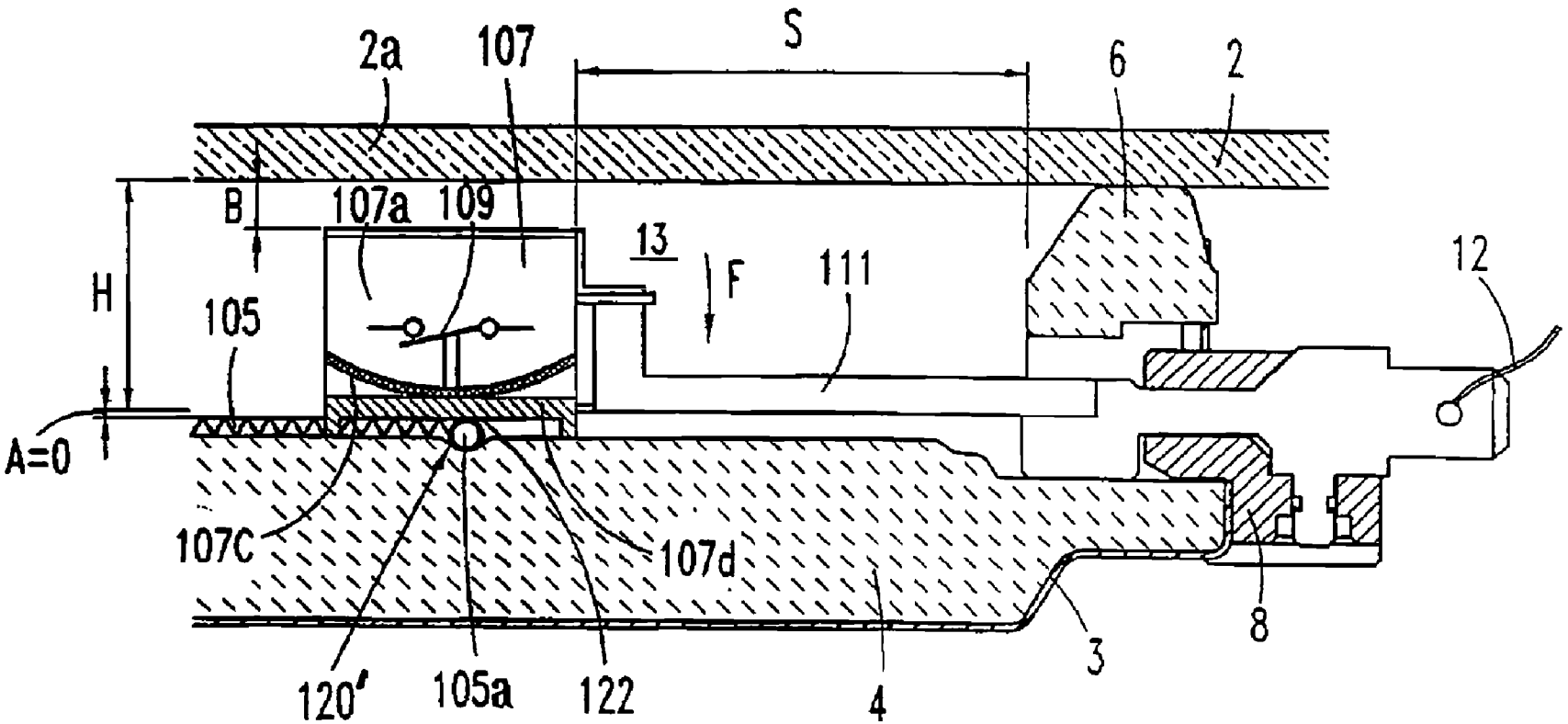
FIG. 3 is a close view of the radiant heater in FIG. 1, showing a variant of the thermal switch construction.

In reference to FIG. 3, a version of radiant heater 101 is shown in which said resistor segment lO5*a* is fixed in a surface guiding groove 120'. The resistor segment lO5*a* stands proud here of the insulating support surface area 104*a*, and the sensor metal base 107*d* lies above the guiding groove 120' in contact with the resistor segment 105*a*, forming an air channel 122 that transmits heat to the metal base 107*d*. To prevent it from being flattened, the metal base 107*d* is substantially straight but with two projections squared on the side edges, between which the resistor segment 105*a* passes, standing proud of the insulating base 104*a*. The metal base 107*d* may also be formed according to other versions, for example by means of two inclined walls forming a triangular cavity for the resistor segment 105*a* on the insulating support surface area 104*a*, or else with a single lateral projection forming an angle with the straight metal base 107*d*, thus positioned with an inclination on the insulating support surface area 104*a*. By means of these versions of the metal base 107*d* a cavity is formed on the insulating surface area 104*a*, by way of which the resistor segment 105*a* passes, making substantially a thermal contact with it.

The sensor electrical contact 109 is connected by two rigid cables 111 to the peripheral electrical connector 8, from which the signalling lamp is illuminated via a line 12. For the fastening of the bimetal sensor 107 on the heater, the elasticity of the metal cables 111 extended with a small angle of inclination, produces a force "E" applied to the body of the sensor 107*a* against the insulating support surface 104*a*. The position of the sensor 107 is thus held fixed against the movements produced by the thermal stresses.

If the radiant heater 101 has the resistor segment 105*a* protruding from the surface 104*a*of the insulating base, the bimetal sensor 107 may optionally be positioned very close to the resistor segment 105*a*, with the vertical metal base 107*b* oriented towards it and a very small distance "A" apart, including also the contact distance A=0 between them, in order that the installation of the bimetal sensor 107 will not interfere with the resistor 105.

Figure 2A:
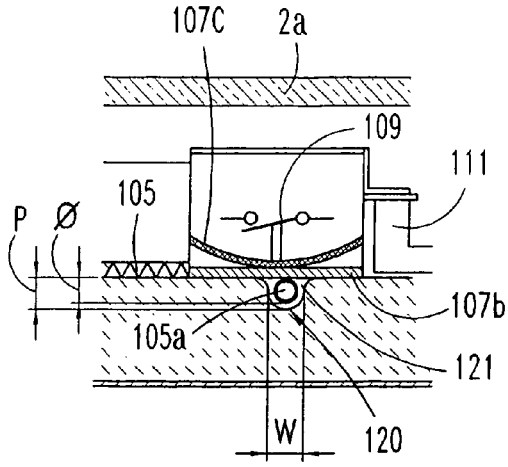
FIG. 2A shows a detail of the heater in FIG. 2, the relative position of the bimetal sensor within the radiant heater.
Figure 4:
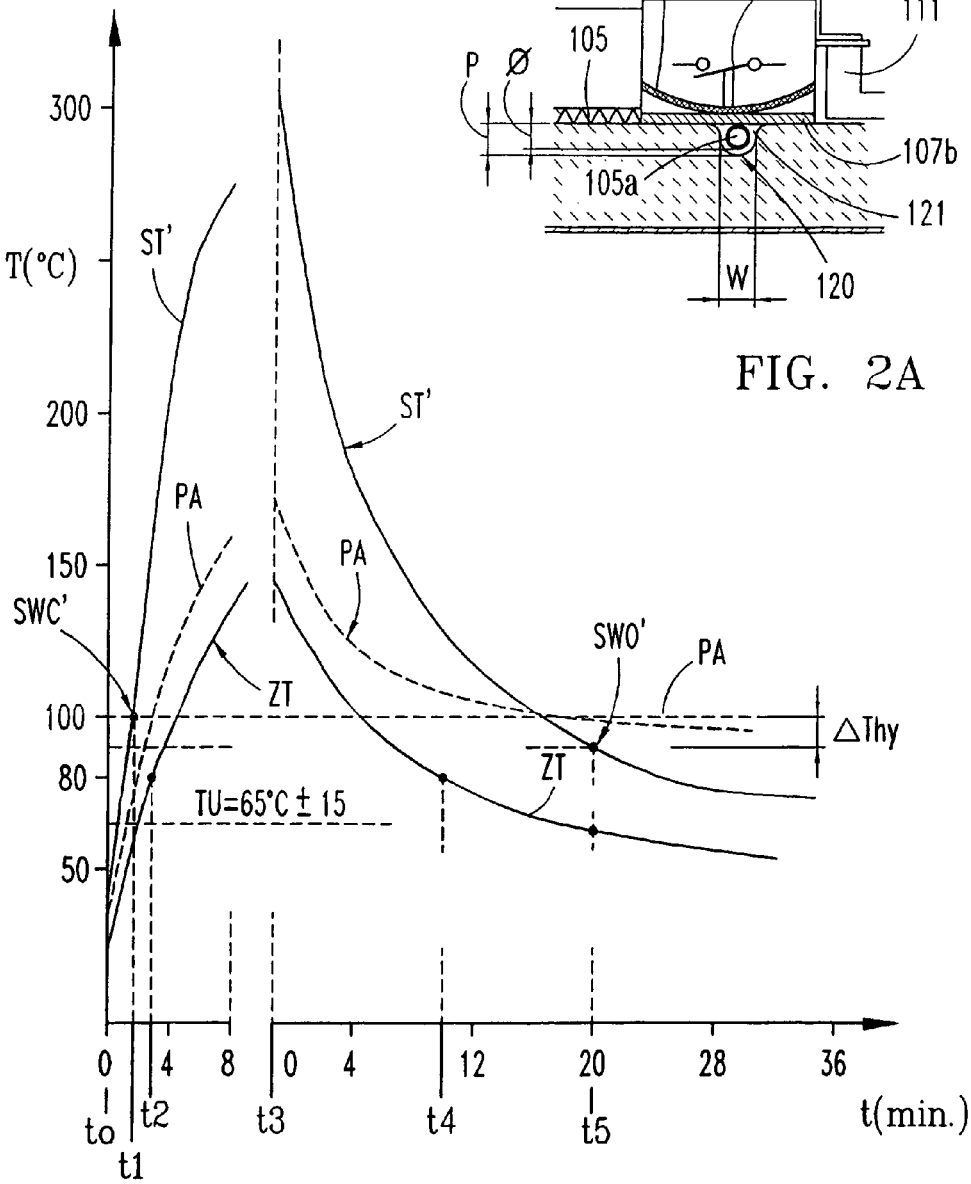
FIG. 4 is a diagram of the resultant temperature in the cooking plate area by the radiant heater of FIGS. 1-3, compared with the temperature value at the bimetal sensor.

In reference to FIG. 4, in a temperature (T)/time (t) diagram the results are shown of the actual measurement at the plate area 2*a*, represented by a curve ZT, and of the temperature detected by the bimetal sensor 107, represented by a curve ST', wherein the bimetal sensor 107 has been positioned above the resistor segment 105*a*, in either of the two embodiments of FIG. 2-2A and FIG. 3. Curve PA represents the changes in the temperature in the bimetal sensor in aforementioned heater of the prior art.

The temperature curve "ZT" has been measured in the heated plate area 2*a*, with a food container on top, and has reached around 150.degree. C. The bimetal sensor 107 has been regulated at the switching point SWC SWO' of the switch contact 109, for example SWC'=100.degree. C. and SWO'=90.degree. C., the most suitable during the cooling process, in the most unfavourable condition for the cooling of the bimetal sensor 107, the radiant heater 101 being subject to the influence of the adjacent cooking heaters that are also in operation. Characteristic of a commercial type thermal switch or bimetal sensor 107, it is an intermediate setting of the switching point SWC', SWO' of the electrical contact between the two rising and falling values, respectively, which has been found as appropriate 100.degree. C. A differential hysteresis value "ΔThy" between SWC' and SWO' is represented.

The instants of time "t0" to "t5" marked in the diagram of FIG. 4 correspond to: t0: heater ON; t1: temperature ST' rising, the setting point SWC'=100 is reached for the closure switching of the electrical contact 109; t2: temperature "ZT" rising, the plate area 2*a* reaches a value in the signalling range TU=65° C.±15; t3: heater OFF; t4: plate 2*a* falls until reaching a value in the signalling range TU=65° C.±15; t5: it is reached with the setting point SWO'=100° C. –"ΔThy" dropping, for the opening switching of the electrical contact 109.

Due to a rapid heating of the bimetal sensor 107, the switching instant "t1" of the electrical contact 109 is reached quickly, before 1 minute has passed from the start t0 of the heating of the plate ZT, when the latter reaches the minimum signalling lamp ignition threshold value TU=50° C.

During the lowering of temperature ZT, the switching instant "t5" at the setting point SWO'=90° C. of the electrical contact 109 is reached without delay in respect of the mean value TU=65° C. of the plate area 2*a*, since curve ST' of the bimetal sensor has a down-slope in close correlation to the plate curve ZT. The air channel 121 below the bimetal sensor 107 cools at the same time as plate area 2*a* when the heating resistor is OFF. With regard to instant "t4" in the fall down to the maximum admissible temperature without signalling TU (max)=80° C. of the plate, the delay interval t5-t4, around 10 minutes, in the opening switching of the electrical contact 109 without the lamp going off is acceptable by the user.

In the diagram in FIG. 4 the curve PA obtained in the afore-mentioned prior art heater, wherein the bimetal sensor is inserted in the peripheral wall of the heater, has been interposed. Due to its indirect warming from the adjacent cooking heaters, during cooling the sensor does not detect the variation in the temperature of the plate area below 100° C., so the switch has to be set at a very high opening point in relation to the highest plate temperature TU (max)=80° C. admissible, or otherwise the delay in switching, instant "t5", may be extended indefinitely, even when the plate temperature has dropped below the minimum indication value "TU (min)"=50° C.

What is claimed is:

1. A cooking appliance comprising:

a cooking plate;

a warning indicator for indicating when the cooking plate is hot;

an insulating base located below and spaced a distance from the cooking plate;

a peripheral insulating ring positioned between the insulating base and the cooking plate, the cooking plate, insulating base and insulating ring defining an internal air cavity;

a heating element positioned on or within at least a portion of the insulating base for heating the cooking plate; and a thermal sensor comprising a housing formed by a heat insulated body and a thermally conductive base, the housing located entirely within the internal air cavity and spaced a distance from the peripheral insulating ring, the thermally conductive base situated in close proximity to the heating element, the thermal sensor further comprising a bimetallic element thermally coupled to the conductive base and mechanically coupled to an electrical switch, the electrical switch electrically coupled to the warning indicator, the bimetallic element configured to act upon the electrical switch to activate the warning indicator when the temperature of the conductive base is at a designated temperature or within a designated temperature range.

2. A cooking appliance according to claim 1 wherein the thermally conductive base of the thermal sensor is in direct contact with the heating element.

3. A cooking appliance according to claim 1 wherein an air gap exists between the heating element and the thermally conductive base of the thermal sensor.

4. A cooking appliance according to claim 1 wherein the heating element is positioned within a groove in the insulating base, a portion of the heating element extending outside the groove and being in direct contact with the thermally conductive base of the thermal sensor.

5. A cooking appliance according to claim 1 wherein the heating element is fully positioned within a groove in the insulating base, the dimensional characteristics of the groove being greater than the dimensional characteristics of the heating element so that an air channel exists between them, the thermally conductive base positioned on the insulating base above the heating element so that air within the channel heats the conductive base.

6. A cooking appliance according to claim 1 wherein the thermally conductive base of the thermal sensor receives heat by direct contact with a portion of the heating element and by air within a gap formed between the heating element and the conductive base.

7. A cooking appliance according to claim 1 wherein the thermal sensor is spaced a distance from the cooking plate.

8. A cooking appliance according to claim 7 wherein the distance between the thermal sensor and the cooking plate is less than about 3 millimeters.

9. A cooking appliance according to claim 1 wherein the thermal sensor detects a temperature value in correspondence with the actual temperature of the cooking plate.

10. A cooking appliance according to claim 9 wherein the switching point of the electrical switch correlates to a low temperature range of the cooking plate during heating and cooling of the cooking plate.

11. A cooking appliance according to claim 1 wherein the thermal sensor comprises terminals that are connected to an outer electrical connector located on a peripheral wall of the cooking appliance via at least one rigid cable that is located within the air cavity, the rigid cable exerting a force on the body of the thermal sensor to secure it against the insulating base.

12. A cooking appliance comprising:

a cooking plate;

a warning indicator for indicating when the cooking plate is hot;

an insulating base located below and spaced a distance from the cooking plate;

a peripheral insulating ring positioned between the insulating base and the cooking plate, the cooking plate, insulating base and insulating ring defining an internal air cavity;

a heating element supported at least in part by the insulating base for heating the cooking plate; and a thermal sensor located in the internal air cavity that is thermally insulated from the peripheral insulating ring, the thermal sensor comprising an internal housing formed by a heat insulated body and a thermally conductive base, the thermally conductive base being in direct contact with the heating element, the thermal sensor further comprising a bimetallic element thermally coupled to the conductive base and mechanically coupled to a normally open electrical switch, the electrical switch electrically coupled to the warning indicator, the bimetallic element configured to close the electrical switch to activate the warning indicator when the temperature of the conductive base is at a designated temperature or within a designated temperature range.

13. A cooking appliance according to claim 12 wherein the heating element is positioned within a groove in the insulating base, a portion of the heating element extending outside the groove and being in direct contact with the thermally conductive base of the thermal sensor.

14. A cooking appliance according to claim 12 wherein the thermally conductive base of the thermal sensor receives heat by direct contact with a portion of the heating element and by air within a gap formed between the heating element and the conductive base.

15. A cooking appliance according to claim 12 wherein the thermal sensor is spaced a distance from the cooking plate.

16. A cooking appliance according to claim 15 wherein the distance between the thermal sensor and the cooking plate is less than about 3 millimeters.

17. A cooking appliance according to claim 12 wherein the thermal sensor detects a temperature value in correspondence with the actual temperature of the cooking plate.

18. A cooking appliance according to claim 17 wherein the switching point of the electrical switch correlates to a low temperature range of the cooking plate during heating and cooling of the cooking plate.

19. A cooking appliance according to claim 12 wherein the thermal sensor comprises terminals that are connected to an outer electrical connector located on a peripheral wall of the cooking appliance via at least one rigid cable that is located within the air cavity, the rigid cable exerting a force on the body of the thermal sensor to secure it against the insulating base.

20. A cooking appliance comprising:

a cooking plate;

a warning indicator for indicating when the cooking plate is hot;

an insulating base located below and spaced a distance from the cooking plate;

a peripheral insulating ring positioned between the insulating base and the cooking plate, the cooking plate, insulating base and insulating ring defining an internal air cavity;

a heating element supported at least in part by the insulating base for heating the cooking plate; and a thermal sensor located in the internal air cavity that is thermally insulated from the peripheral insulating ring, the thermal sensor comprising an internal housing formed by a heat insulated body and a thermally conductive base, the thermally conductive base situated in close proximity to the heating element, the thermal sensor further comprising a bimetallic element thermally coupled to the conductive base and mechanically coupled to a normally open electrical switch, the electrical switch electrically coupled to the warning indicator, the bimetallic element configured to close the electrical switch to activate the warning indicator when the temperature of the conductive base is at a designated temperature or within a designated temperature range, the thermal sensor comprising terminals that are connected to an outer electrical connector located on a peripheral wall of the cooking appliance via at least one rigid cable that is located within the air cavity, the rigid cable exerting a force on the body of the thermal sensor to secure it against the insulating base.

* * * * *